US012345439B2

(12) United States Patent
Robinson, III et al.

(10) Patent No.: US 12,345,439 B2
(45) Date of Patent: Jul. 1, 2025

(54) DAMPER DOOR FOR AN AIR CONDITIONING APPLIANCE

(71) Applicant: Haier US Appliance Solutions, Inc., Wilmington, DE (US)

(72) Inventors: Charles D. Robinson, III, Louisville, KY (US); Joseph Robert Tobbe, Louisville, KY (US); Gregory Miller, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 218 days.

(21) Appl. No.: 18/193,327

(22) Filed: Mar. 30, 2023

(65) Prior Publication Data

US 2024/0328665 A1 Oct. 3, 2024

(51) Int. Cl.
*F24F 13/14* (2006.01)

(52) U.S. Cl.
CPC .... *F24F 13/1426* (2013.01); *F24F 2013/146* (2013.01)

(58) Field of Classification Search
CPC ..... F24F 13/1426; F24F 2013/146; F24F 2003/005; F24F 3/001
See application file for complete search history.

(56) References Cited

U.S. PATENT DOCUMENTS 4,018,266 A * 4/1977 Kay ..... F24F 11/62 165/48.1
4,227,378 A * 10/1980 Thoren ..... F24F 3/001 62/409
4,266,599 A * 5/1981 Saunders ..... F24F 11/46 62/157
4,347,708 A * 9/1982 Bussjager ..... F24F 1/0323 62/DIG. 16
4,404,815 A * 9/1983 Gilson ..... F25D 1/00 62/196.2
7,188,481 B2 3/2007 DeYoe et al.
7,565,924 B2 7/2009 Marcoux et al.
11,175,054 B2 11/2021 Shaffer
2020/0263899 A1* 8/2020 Sethuraj ..... F24F 11/70
2021/0071881 A1* 3/2021 Shaffer ..... F24F 1/0358

FOREIGN PATENT DOCUMENTS

CN 109579139 A 4/2019

* cited by examiner

*Primary Examiner* — David J Teitelbaum
(74) *Attorney, Agent, or Firm* — Dority & Manning, P.A.

(57) ABSTRACT

A single-package air conditioner appliance includes a housing defining an outdoor portion and an indoor portion; an outdoor heat exchanger assembly disposed in the outdoor portion; an indoor heat exchanger assembly disposed in the indoor portion; a compressor in fluid communication with the outdoor heat exchanger and the indoor heat exchanger; an intake conduit extending from the housing, the intake conduit defining an intake passage upstream from the indoor inlet, the intake conduit further defining a secondary inlet upstream from the intake passage to permit air thereto; a secondary air duct extending from the intake conduit outside of the housing upstream from the secondary inlet to direct air thereto, the secondary air duct defining a secondary air passage; and a damper door provided in the secondary air duct to allow air therethrough, the damper door including a spring member selectively biasing the damper door against the secondary air duct.

18 Claims, 9 Drawing Sheets

DAMPER DOOR FOR AN AIR CONDITIONING APPLIANCE

FIELD OF THE INVENTION

The present subject matter relates generally to air conditioning appliances, and more particularly to assemblies for providing make-up air to air conditioning appliances.

BACKGROUND OF THE INVENTION

Air conditioner or air conditioning appliance units are conventionally used to adjust the temperature within structures such as dwellings and office buildings. In particular, one-unit type room air conditioner units, such as single-package vertical units (SPVU), may be used to adjust the temperature in, for example, a single room or group of rooms of a structure. A typical one-unit type air conditioner or air conditioning appliance includes an indoor portion and an outdoor portion. The indoor portion generally communicates (e.g., exchanges air) with the area within a building, and the outdoor portion generally communicates (e.g., exchanges air) with the area outside a building. Accordingly, the air conditioner unit generally extends through, for example, an outer wall of the structure. Generally, a fan may be operable to rotate to motivate air through the indoor portion. Another fan may be operable to rotate to motivate air through the outdoor portion. A sealed cooling system including a compressor is generally housed within the air conditioner unit to treat (e.g., cool or heat) air as it is circulated through the indoor portion of the air conditioner unit. One or more control boards are typically provided to direct the operation of various elements of the particular air conditioner unit.

Frequently, the indoor space may need to draw in air from the outdoors (i.e., make-up air). Some air conditioner units can allow for the introduction of make-up air into the indoor space via a secondary duct. A door may be provided within the secondary duct to selectively allow the make-up air into the indoor space. However, current doors produce unwanted noise and can generate high levels of potentially damaging torque on operating motors due to sudden stops at opening or closing positions.

As a result, it would be useful to provide an air conditioning appliance or door assembly that includes features for addressing one or more of the above issues. In particular, it may be advantageous to provide an appliance or assembly with features for controlling a door within an air duct of an air conditioning unit.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a single-package air conditioner appliance is provided. The single-package air conditioner appliance may include a housing defining an outdoor portion and an indoor portion, the housing further defining an indoor inlet upstream from the indoor portion and an outdoor outlet downstream from the outdoor portion; an outdoor heat exchanger assembly disposed in the outdoor portion and including an outdoor heat exchanger and an outdoor fan; an indoor heat exchanger assembly disposed in the indoor portion and including an indoor heat exchanger and an indoor fan; a compressor in fluid communication with the outdoor heat exchanger and the indoor heat exchanger to circulate a refrigerant between the outdoor heat exchanger and the indoor heat exchanger; an intake conduit extending from the housing, the intake conduit defining an intake passage upstream from the indoor inlet, the intake conduit further defining a secondary inlet upstream from the intake passage to permit air thereto; a secondary air duct extending from the intake conduit outside of the housing upstream from the secondary inlet to direct air thereto, the secondary air duct defining a secondary air passage; and a damper door provided in the secondary air duct to selectively allow air therethrough, the damper door including a spring member selectively biasing the damper door against the secondary air duct.

In another exemplary aspect of the present disclosure, a make-up air (MUA) assembly for a single-package air conditioner appliance is provided. The MUA assembly may include an intake conduit attachable to the housing, the intake conduit defining an intake passage upstream from the indoor inlet, the intake conduit further defining a secondary inlet upstream from the intake passage to permit air thereto; a secondary air duct extending from the intake conduit outside of the housing upstream from the secondary inlet to direct air thereto, the secondary air duct defining a secondary air passage; and a damper door provided in the secondary air duct to selectively allow air therethrough, the damper door including a spring member selectively biasing the damper door against the secondary air duct.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
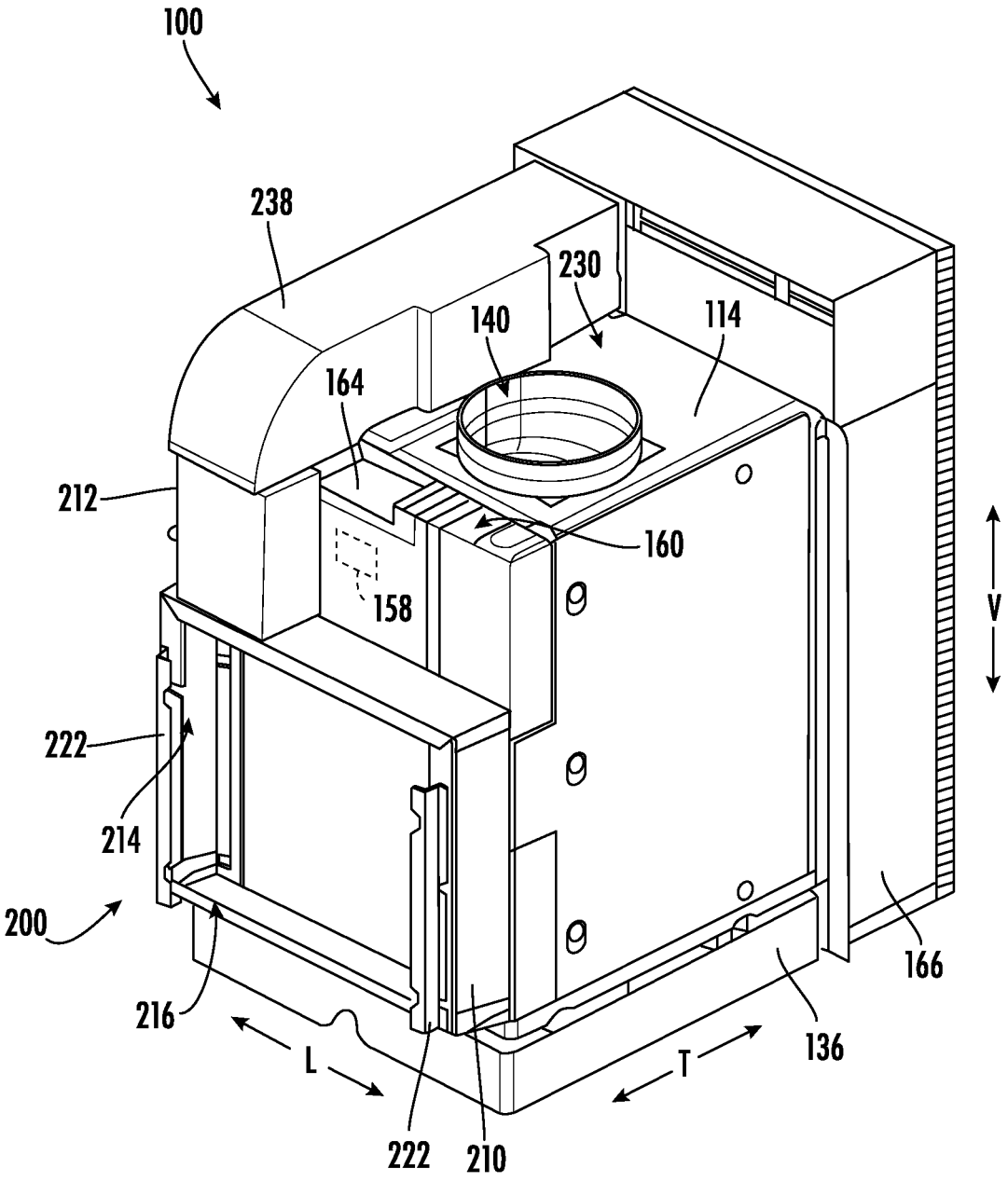
FIG. 1 provides a perspective view of an air conditioning appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
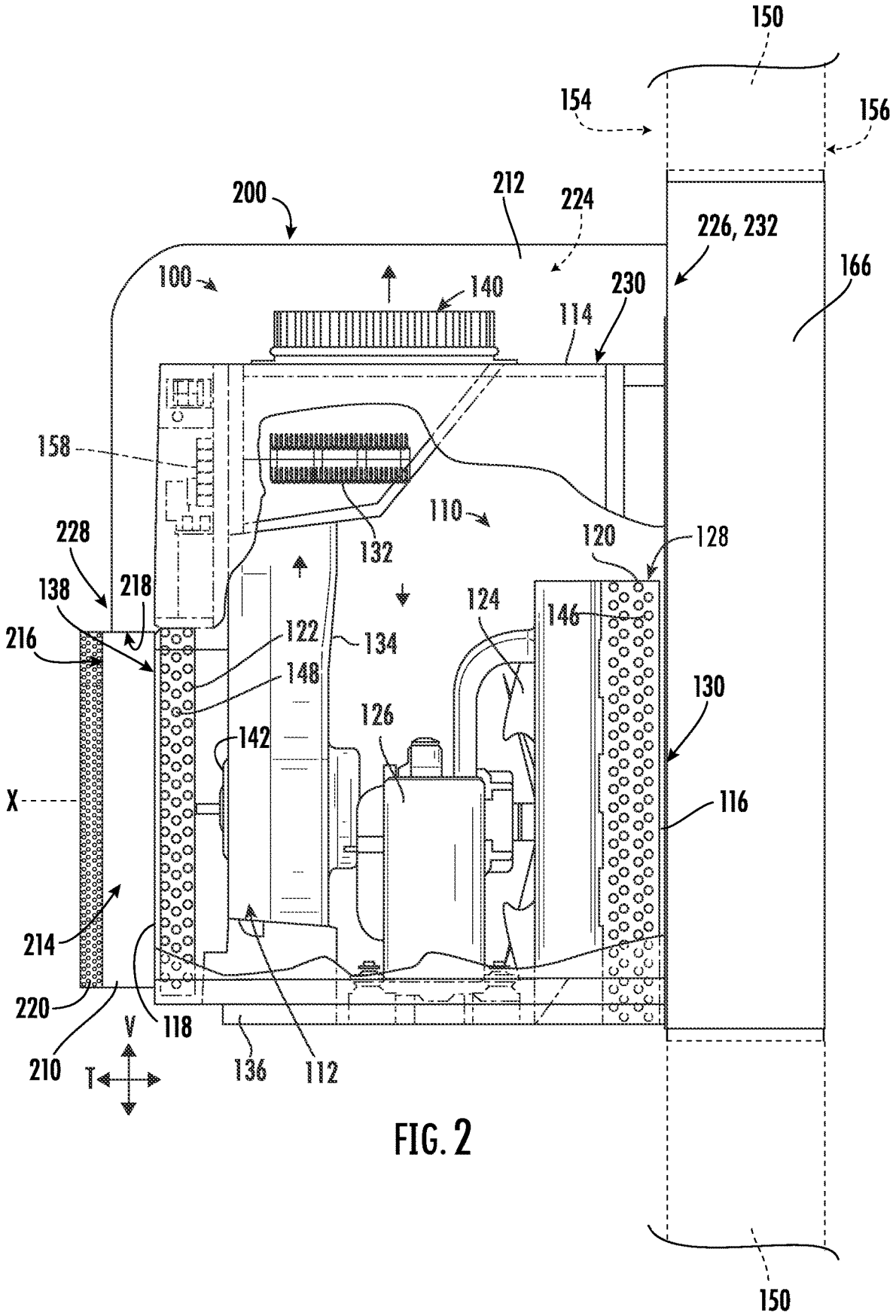
FIG. 2 provides a partially-transparent elevation view of the exemplary air conditioner unit of FIG. 1.
Figure 3:
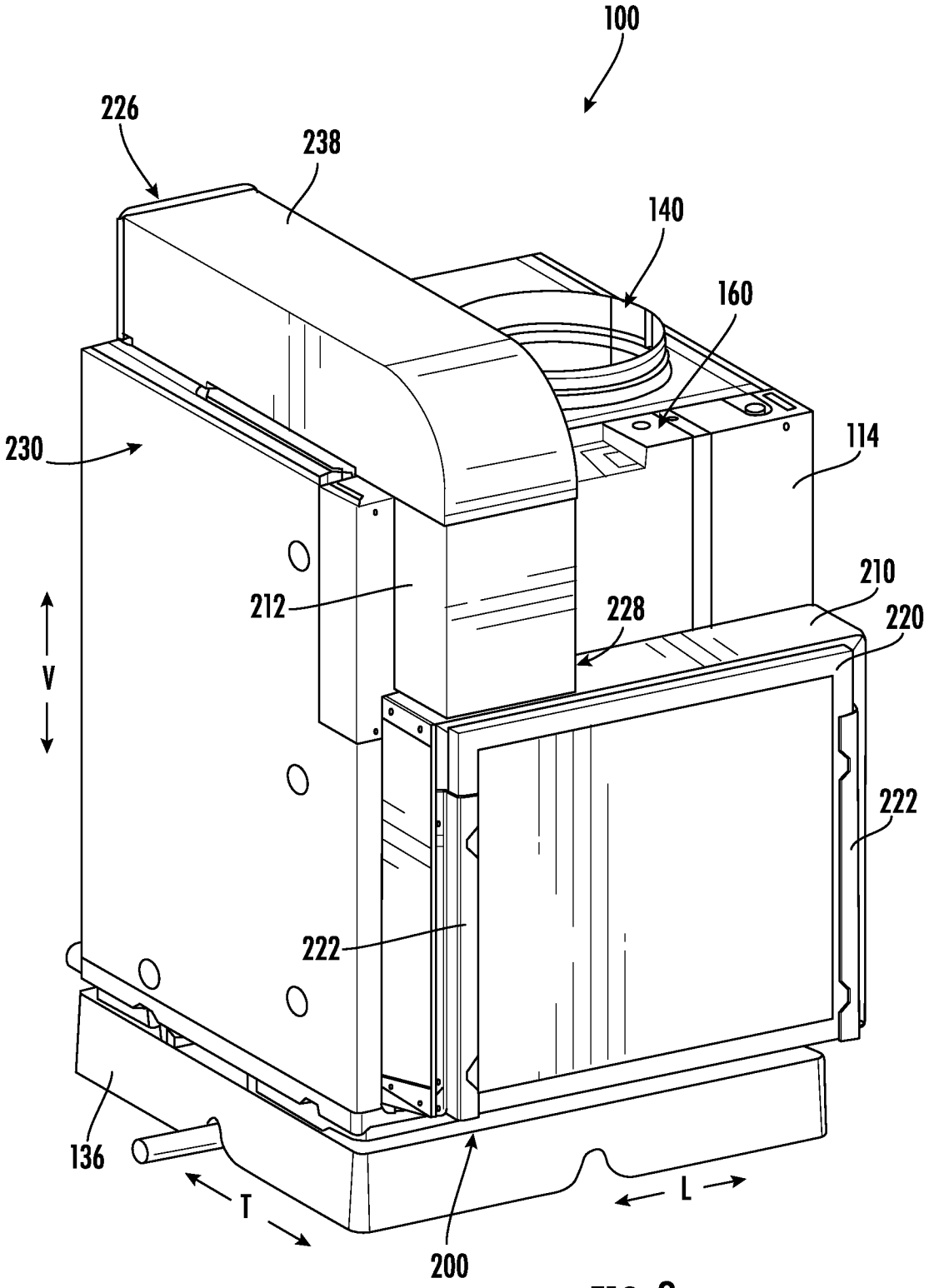
FIG. 3 provides another perspective view of the exemplary air conditioner unit of FIG. 1.

Turning now to the figures, FIGS. 1 through 3 illustrate an exemplary air conditioner appliance (e.g., air conditioner 100). As shown, air conditioner 100 may be provided as a one-unit type air conditioner 100, such as a single-package vertical unit. Air conditioner 100 includes a package housing 114 supporting an indoor portion 112 and an outdoor portion 110.

Generally, air conditioner 100 defines a vertical direction V, lateral direction L, and transverse direction T. Each direction V. L. T is perpendicular to each other, such that an orthogonal coordinate system is generally defined.

In some embodiments, housing 114 contains various other components of the air conditioner 100. Housing 114 may include, for example, a rear opening 116 (e.g., with or without a grill or grate thereacross) and a front opening 118 (e.g., with or without a grill or grate thereacross) may be spaced apart from each other along the transverse direction T. The rear opening 116 may be part of the outdoor portion 110, while the front opening 118 is part of the indoor portion 112. Components of the outdoor portion 110, such as an outdoor heat exchanger 120, outdoor fan 124, and compressor 126 may be enclosed within housing 114 between front opening 118 and rear opening 116. In certain embodiments, one or more components of outdoor portion 110 are mounted on a basepan 136, as shown.

During certain operations, air may be drawn to outdoor portion 110 through rear opening 116. Specifically, an outdoor inlet 128 defined through housing 114 may receive outdoor air motivated by outdoor fan 124. Within housing 114, the received outdoor air may be motivated through or across outdoor fan 124. Moreover, at least a portion of the outdoor air may be motivated through or across outdoor heat exchanger 120 before exiting the rear opening 116 at an outdoor outlet 130. It is noted that although outdoor inlet 128 is illustrated as being defined above outdoor outlet 130, alternative embodiments may reverse this relative orientation (e.g., such that outdoor inlet 128 is defined below outdoor outlet 130) or provide outdoor inlet 128 beside outdoor outlet 130 in a side-by-side orientation, or another suitable discrete orientation.

As shown, indoor portion 112 may include an indoor heat exchanger 122, a blower fan 142, and a heating unit 132. These components may, for example, be housed behind the front opening 118. A bulkhead 134 may generally support or house various other components or portions thereof of the indoor portion 112, such as the blower fan 142. Bulkhead 134 may generally separate and define the indoor portion 112 and outdoor portion 110 within housing 114. Additionally or alternatively, bulkhead 134 or indoor heat exchanger 122 may be mounted on basepan 136 (e.g., at a higher vertical position than outdoor heat exchanger 120), as shown.

During certain operations, air may be drawn to indoor portion 112 through front opening 118. Specifically, an indoor inlet 138 defined through housing 114 may receive indoor air motivated by blower fan 142. At least a portion of the indoor air may be motivated through or across indoor heat exchanger 122 (e.g., before passing to bulkhead 134). From blower fan 142, indoor air may be motivated (e.g., across heating unit 132) and returned to the indoor area of the room through an indoor outlet 140 defined through housing 114 (e.g., above indoor inlet 138 along the vertical direction V). Optionally, one or more conduits (not pictured) may be mounted on or downstream from indoor outlet 140 to further guide air from air conditioner 100. It is noted that although indoor outlet 140 is illustrated as generally directing air upward, it is understood that indoor outlet 140 may be defined in alternative embodiments to direct air in any other suitable direction.

Outdoor and indoor heat exchanger 120, 122 may be components of a thermodynamic assembly (i.e., sealed system), which may be operated as a refrigeration assembly (and thus perform a refrigeration cycle) or, in the case of the heat pump unit embodiment, a heat pump (and thus perform a heat pump cycle). Thus, as is understood, exemplary heat pump unit embodiments may be selectively operated perform a refrigeration cycle at certain instances (e.g., while in a cooling mode) and a heat pump cycle at other instances (e.g., while in a heating mode). By contrast, exemplary A/C exclusive unit embodiments may be unable to perform a heat pump cycle (e.g., while in the heating mode), but still perform a refrigeration cycle (e.g., while in a cooling mode).

The sealed system may, for example, further include compressor 126 (e.g., mounted on basepan 136) and an expansion device (e.g., expansion valve or capillary tube—not pictured), both of which may be in fluid communication with the heat exchangers 120, 122 to flow refrigerant therethrough, as is generally understood. The outdoor and indoor heat exchanger 120, 122 may each include coils 146, 148, as illustrated, through which a refrigerant may flow for heat exchange purposes, as is generally understood.

A plenum 166 may be provided to direct air to or from housing 114. When installed, plenum 166 may be selectively attached to (e.g., fixed to or mounted against) housing 114 (e.g., via a suitable mechanical fastener, adhesive, gasket, etc.) and extend through a structure wall 150 (e.g., an outer wall of the structure within which air conditioner 100 is installed). For instance, plenum 166 may extend (e.g., parallel to the transverse direction T) through a hole or channel 152 in the structure wall 150 that passes from an internal surface 154 to an external surface 156.

As will be described in greater detail below, a make-up air assembly 200 may be provided to selectively direct outdoor or make-up air to the indoor portion 112. Specifically, make-up air assembly 200 may direct outdoor air through the structure outer or wall 150 of the structure within which air conditioner 100 is installed (e.g., via plenum 166) and to indoor heat exchanger 122 without first directing such outdoor or make-up air through housing 114. To that end, make-up air assembly 200 may include one or more air ducts or conduits (e.g., intake conduit 210 or secondary air duct 212) defining one or more air paths outside of housing 114. During use, the flow of make-up air may thus be fluidly isolated from the flow of air through outdoor portion 110.

The operation of air conditioner 100 including compressor 126 (and thus the sealed system generally), blower fan 142, outdoor fan 124, heating unit 132, and other suitable components may be controlled by a control board or controller 158. Controller 158 may be in communication (via for example a suitable wired or wireless connection) to such components of the air conditioner 100. By way of example, the controller 158 may include a memory and one or more processing devices such as microprocessors, CPUs or the like, such as general or special purpose microprocessors operable to execute programming instructions or micro-control code associated with operation of air conditioner 100. The memory may be a separate component from the processor or may be included onboard within the processor. The memory may represent random access memory such as DRAM, or read only memory such as ROM or FLASH.

Air conditioner 100 may additionally include a control panel 160 and one or more user inputs 162, which may be included in control panel 160. The user inputs 162 may be in communication with the controller 158. A user of the air conditioner 100 may interact with the user inputs 162 to operate the air conditioner 100, and user commands may be transmitted between the user inputs 162 and controller 158 to facilitate operation of the air conditioner 100 based on such user commands. A display 164 may additionally be provided in the control panel 160, and may be in communication with the controller 158. Display 164 may, for example be a touchscreen or other text-readable display screen, or alternatively may simply be a light that can be activated and deactivated as required to provide an indication of, for example, an event or setting for the air conditioner 100.

Figure 4:
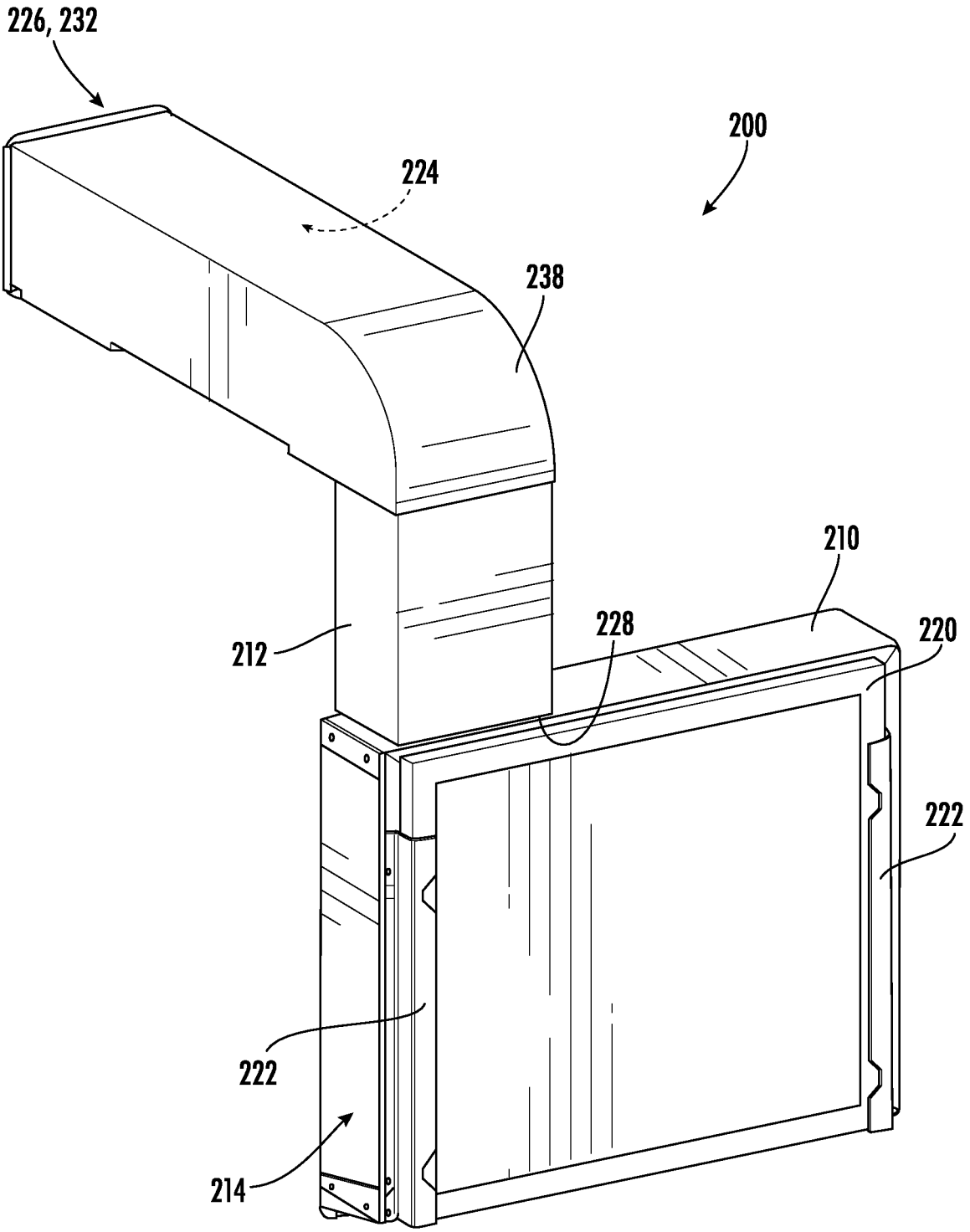
FIG. 4 provides a perspective view of the make-up air assembly of the exemplary air conditioner unit of FIG. 1.
Figure 5:
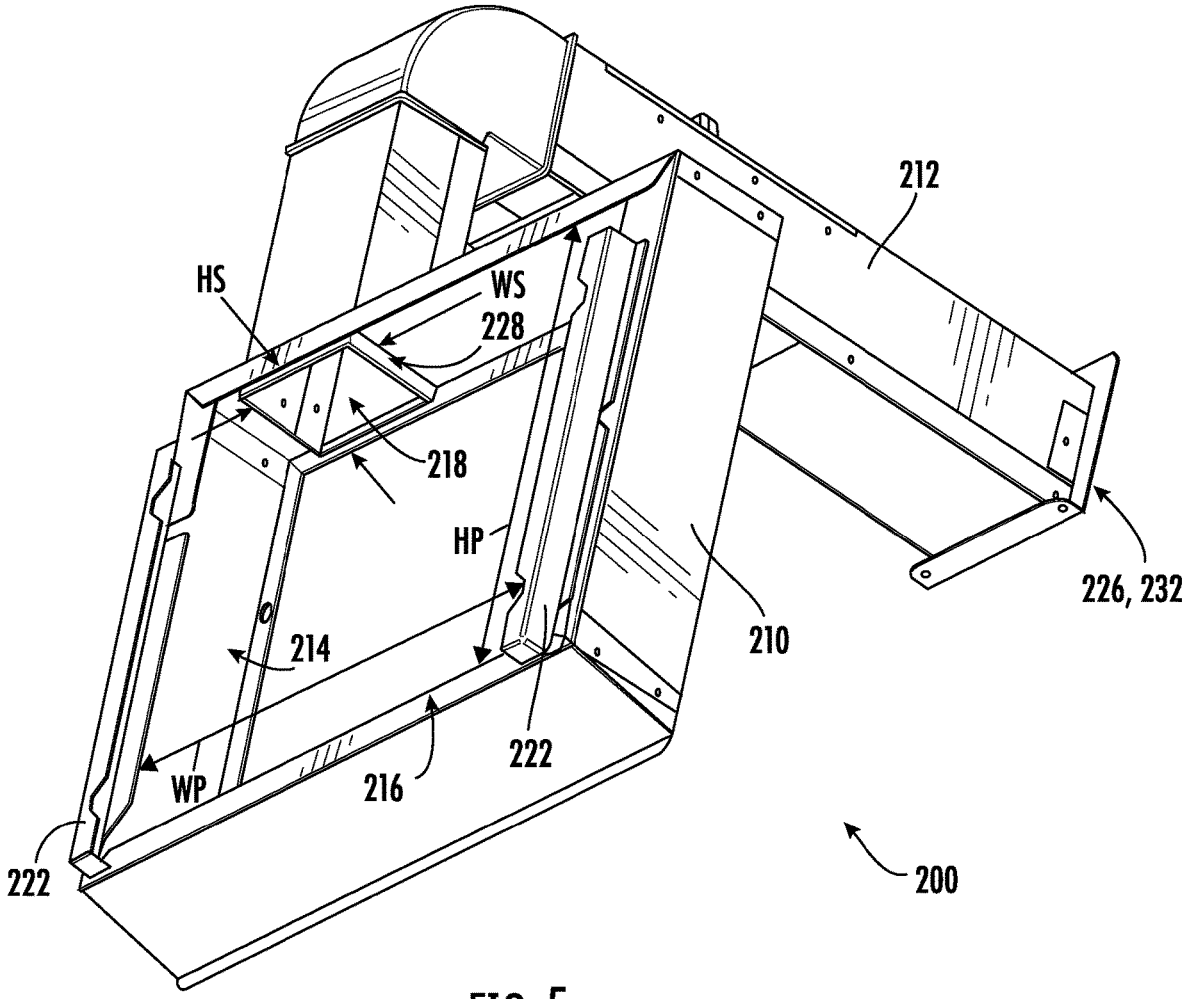
FIG. 5 provides another perspective view of the make-up air assembly of the exemplary air conditioner unit of FIG. 1.
Figure 6:
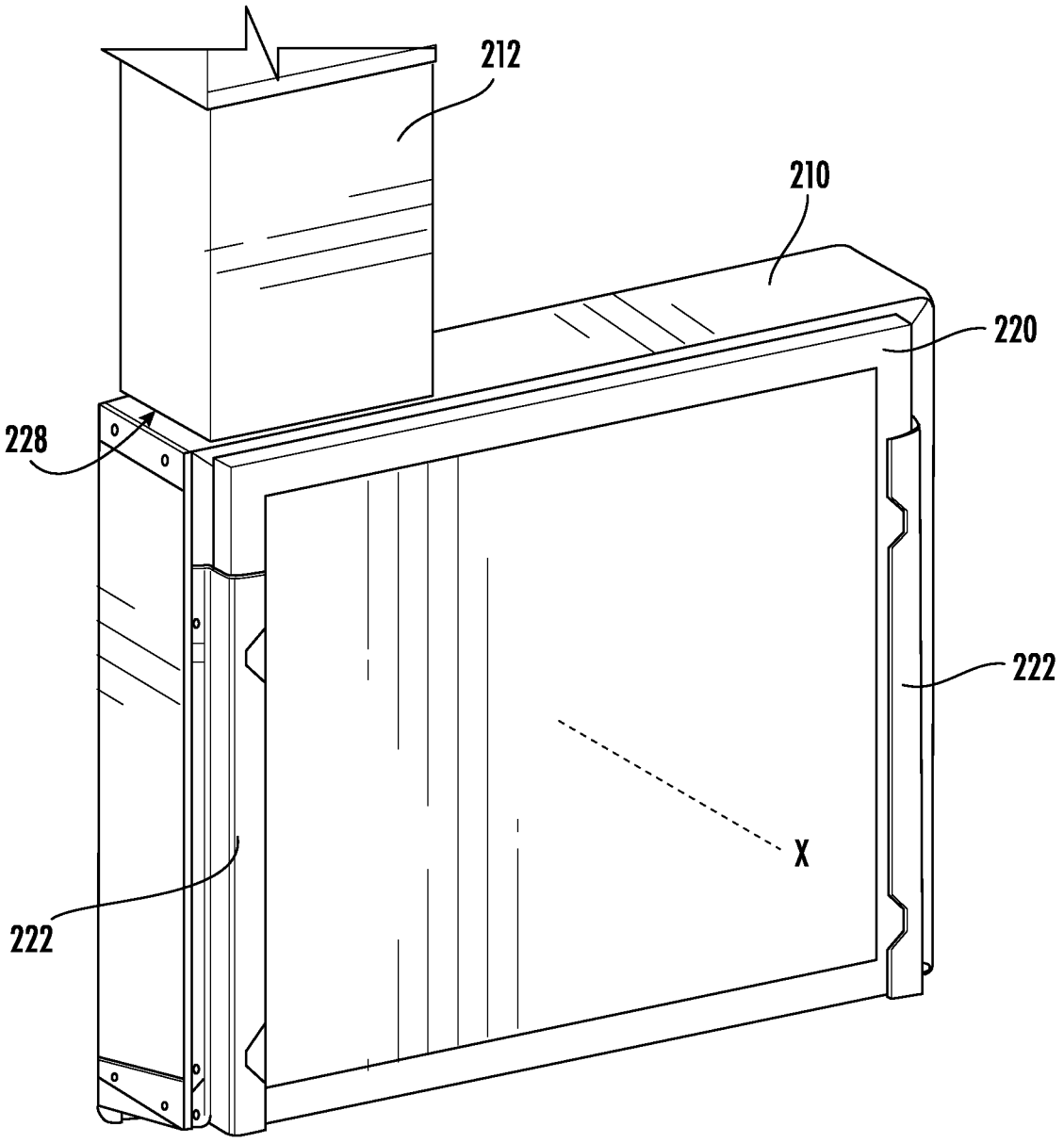
FIG. 6 provides a perspective view of the intake conduit of the make-up assembly of the exemplary air conditioner unit of FIG. 1.
Figure 7:
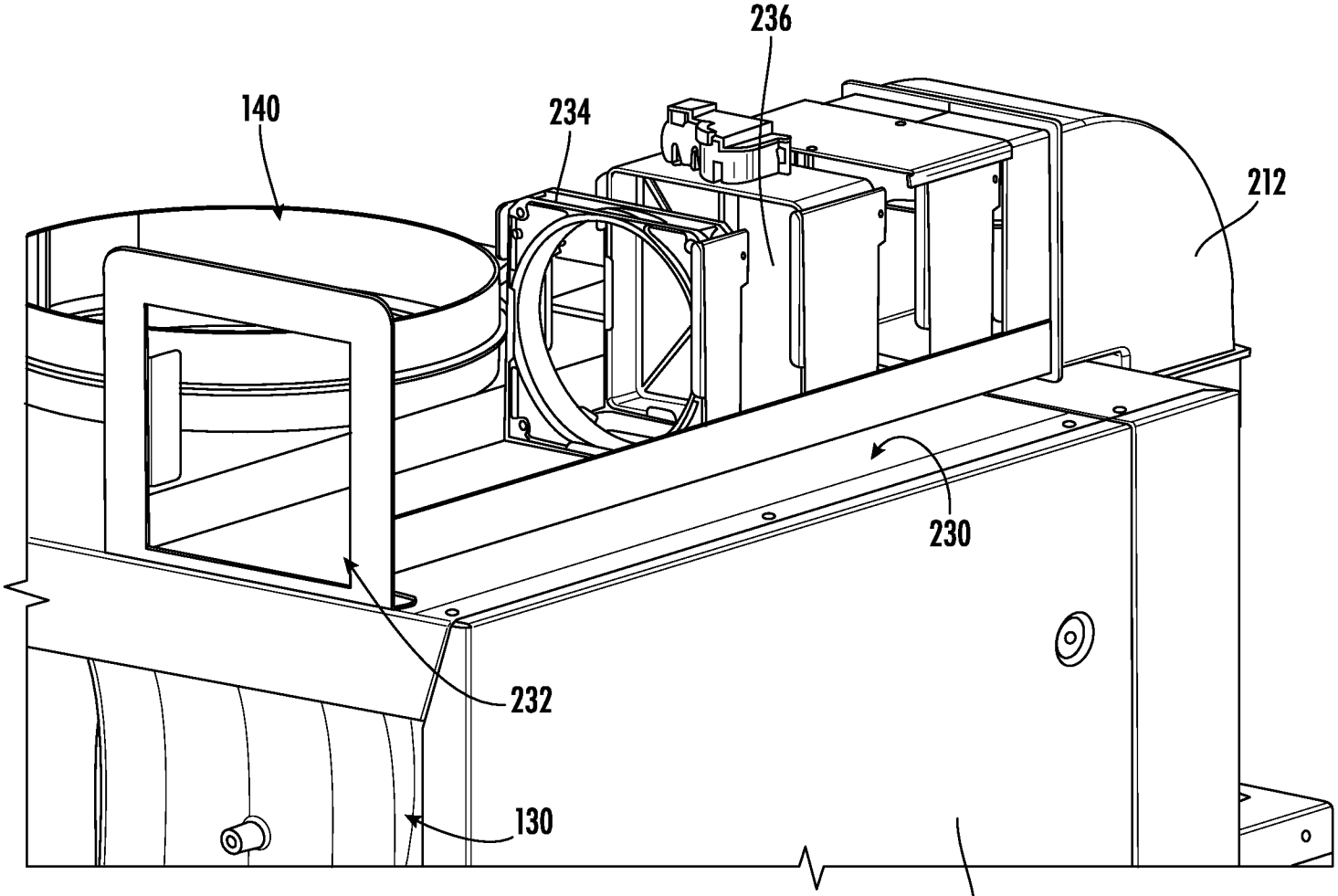
FIG. 7 provides a perspective view of a portion of the make-up assembly of the exemplary air conditioner unit of FIG. 1, wherein certain components have been removed for the sake of clarity.

Turning now especially to FIGS. 2 through 7, an exemplary make-up air assembly 200 will be described in greater detail. FIGS. 4 through 6, in particular, provide various views of make-up air assembly 200 (and portions thereof) in isolation (e.g., apart from housing 114), while FIG. 7 provides a view of make-up air assembly 200 wherein a portion of secondary air duct 212 is removed for clarity (e.g., at a top portion of housing 114).

As noted above, make-up air assembly 200 may be generally provided to selectively direct outdoor air to the indoor portion 112. To that end, make-up air assembly 200 may include an intake conduit 210 that defines an intake passage 214 upstream from indoor inlet 138. As shown, intake conduit 210 extends outward from housing 114. For instance, intake passage 214 may extend along a passage axis X (e.g., horizontal or parallel to the transverse direction T), which the intake conduit 210 generally surrounds or radially bounds. In some such embodiments, intake passage 214 is parallel to passage axis X. When assembled, intake conduit 210 may be mounted to housing 114, such as on an outer surface 230 of housing 114. In turn, intake passage 214 may extend from a primary air inlet 216 (i.e., primary inlet), which is defined as an opening or aperture of intake conduit 210, to indoor inlet 138. Thus, primary air inlet 216 is spaced apart from indoor inlet 138 (e.g., along the transverse direction T). In some embodiments, primary air inlet 216 is coaxial with indoor inlet 138. For instance, both primary air inlet 216 and indoor inlet 138 may be defined along the passage axis X. In turn, intake passage 214 may be a linear passage from primary air inlet 216 to indoor inlet 138.

Generally, primary air inlet 216 defines an airflow cross section (e.g., minimum cross section) along a plane perpendicular to airflow through primary air inlet 216. For instance, in the illustrated embodiments, the airflow cross section of primary air inlet 216 is defined by the dimensions of the height HP multiplied by the width WP.

Along with defining primary air inlet 216, intake conduit 210 may define a secondary air inlet 218 (i.e., secondary inlet). In particular, secondary air inlet 218 may be defined separate from primary air inlet 216. When assembled, secondary air inlet 218 may be spaced apart from primary air inlet 216. For instance, secondary air inlet 218 may be defined in fluid parallel to primary air inlet 216. Thus, airflow through secondary air inlet 218 to intake passage 214 may be distinct from airflow through primary air inlet 216. Moreover, upstream from intake passage 214, the airflows through secondary air inlet 218 and primary air inlet 216 may be independent from (i.e., not commingled with) each other.

In some embodiments, secondary air inlet 218 is defined along a non-parallel angle relative to primary air inlet 216 (i.e., such that primary air inlet 216 and secondary air inlet 218 are not defined along geometric parallel axes). For instance, secondary air inlet 218 may be defined through intake conduit 210 perpendicular to primary air inlet 216 (e.g., perpendicular to passage axis X). In optional embodiments, secondary air inlet 218 is defined above primary air inlet 216. Thus, airflow through secondary air inlet 218 to intake passage 214 may flow downward. In additional or alternative embodiments, secondary air inlet 218 is closer to indoor inlet 138 (e.g., relative to the passage axis X) than primary air inlet 216. Thus, secondary air inlet 218 may be proximal to indoor inlet 138 while primary air inlet 216 is distal to indoor inlet 138.

Generally, secondary air inlet 218 defines an airflow cross section (e.g., minimum cross section) along a plane perpendicular to airflow through secondary air inlet 218. For instance, in the illustrated embodiments, the airflow cross section of secondary air inlet 218 is defined by the dimensions of the length HS multiplied by the width WS. In certain embodiments, such as those illustrated in FIGS. 2 through 7, the airflow cross section of secondary air inlet 218 is less than the airflow cross section of primary air inlet 216.

As shown, especially in FIGS. 2 through 4 and 6, a filter panel 220 may be disposed (e.g., selectively or removably disposed) on intake conduit 210. In particular, filter panel 220 may be disposed in fluid communication with intake passage 214 to filter air thereto. For instance, filter panel 220 may be in fluid communication with primary air inlet 216 while being spaced apart from secondary air inlet 218. During use, airflow to intake passage 214 through primary air inlet 216 may thus be forced through filter panel 220 in order to flow to intake passage 214. By contrast, airflow to intake passage 214 through secondary air inlet 218 may advantageously bypass filter panel 220 altogether. Optionally, indoor inlet 138 may be unobstructed by any filtration media, ensuring a direct flow path from intake passage 214 to the indoor portion 112. Notably, bypassing filter panel 220 may prevent significant resistance to make-up air (e.g., while ensuring filtration of most of the airflow, such as the non-makeup airflow to indoor inlet 138).

In some embodiments, filter panel 220 is disposed in front primary air inlet 216 (e.g., along the transverse direction T or otherwise outside from intake passage 214). Moreover, filter panel 220 may be upstream from primary air inlet 216. One or more mounting brackets 222 may be provided to hold filter panel 220 on intake conduit 210. For instance, as illustrated, a pair of mounting brackets 222 that each defining a discrete support channel to slidably receive filter panel 220 may be provided on opposite ends (e.g., opposite lateral ends or vertical ends) of intake conduit 210 or primary air inlet 216. As shown, each mounting bracket 222 may be opened at one end (e.g., a top end) while being closed at an opposite end (e.g., a bottom end) to support filter panel 220 or otherwise prevent filter panel 220 from sliding directly through (i.e., out of) the mounting brackets 222 during installation of filter panel 220 on intake conduit 210. Filter panel 220 itself may be provided as any suitable frame or structure including a suitable air filtration media (e.g., cellulose, fiberglass, foam, etc.).

In some embodiments, a secondary air duct 212 is mounted or attached to intake conduit 210 to direct outdoor (i.e., make-up) air to secondary air inlet 218. Thus, secondary air duct 212 may be disposed upstream from secondary air inlet 218 to direct air thereto. Moreover, secondary air duct 212 may define a secondary passage 224 that extends from an outdoor end 226 to an indoor end 228. In certain embodiments, outdoor end 226 is positioned at or proximal to plenum 166 while indoor end 228 is positioned at or proximal to secondary air inlet 218, as shown.

When assembled, secondary air duct 212 may extend from intake conduit 210 outside of housing 114. Thus, secondary passage 224 may be defined outside of housing 114 apart from indoor portion 112 and outdoor portion 110. In certain embodiments, secondary air duct 212 is disposed on outer surface 230 of housing 114. Thus, while secondary air duct 212 is separate from housing 114, secondary air duct 212 may be held to housing 114 (e.g., as a single unit) without commingling air through outdoor portion 110 and secondary passage 224, or without motivating air within housing 114 across an exterior surface of secondary air duct 212 (e.g., opposite from the interior secondary passage 224). Optionally, an insulation layer 238 (e.g., insulating foam, sheet, or panels) may be disposed on the exterior surface of secondary air duct 212 outside of housing 114.

Outdoor end 226 of secondary air duct 212 defines a duct intake 232 through which outdoor or make-up air may enter secondary passage 224. In certain embodiments, duct intake 232 may be disposed directly above the outdoor outlet 130 (e.g., at the plenum 166). In order to direct air from an outdoor region to intake conduit 210, duct intake 232 is generally offset or spaced apart from secondary air inlet 218 in or along at least one direction (e.g., the transverse direction T). As shown, duct intake 232 may further be offset from secondary air inlet 218 in a second direction (e.g., in the vertical direction V or lateral direction L). In the illustrated embodiments, indoor end 228 (and thus secondary air inlet 218) is both horizontally and vertically offset from duct intake 232. For instance, secondary air inlet 218 may be transversely offset and lower than the duct intake 232. Airflow through secondary passage 224 may thus be drawn forward and downward, notably maintaining a compact assembly while minimizing the resistance of airflow through secondary passage 224.

In some embodiments, one or more movable airflow elements may be disposed or mounted within secondary air duct 212 to selectively motivate or restrict airflow through secondary passage 224. As an example, a make-up fan 234 (e.g., axial fan, tangential fan, etc.) may be mounted within secondary air duct 212 to selectively direct air therethrough. In some such embodiments, controller 158 is in operable (e.g., electric or wireless) communication with make-up fan 234 (e.g., via one or more additional components such as inverter boards or the like). During operation, controller 158 may thus selectively activate or initiate rotation of make-up fan 234 to motivate make-up air to intake conduit 210. As an additional or alternative example, a damper door 236 may be movably mounted in the secondary air duct 212 to selectively permit air therethrough. In some such embodiments, controller 158 is in operable (e.g., electric or wireless) communication with damper door 236 (e.g., a motor thereof, explained below). During operation, controller 158 may thus selectively activate or initiate movement of damper door 236 to an open position to permit motivated make-up air to intake conduit 210. Moreover, controller 158 may separately activate or initiate movement of damper door 236 to a closed position to restrict airflow through secondary air duct 212 (e.g., when make-up air is not desired).

Figure 8:
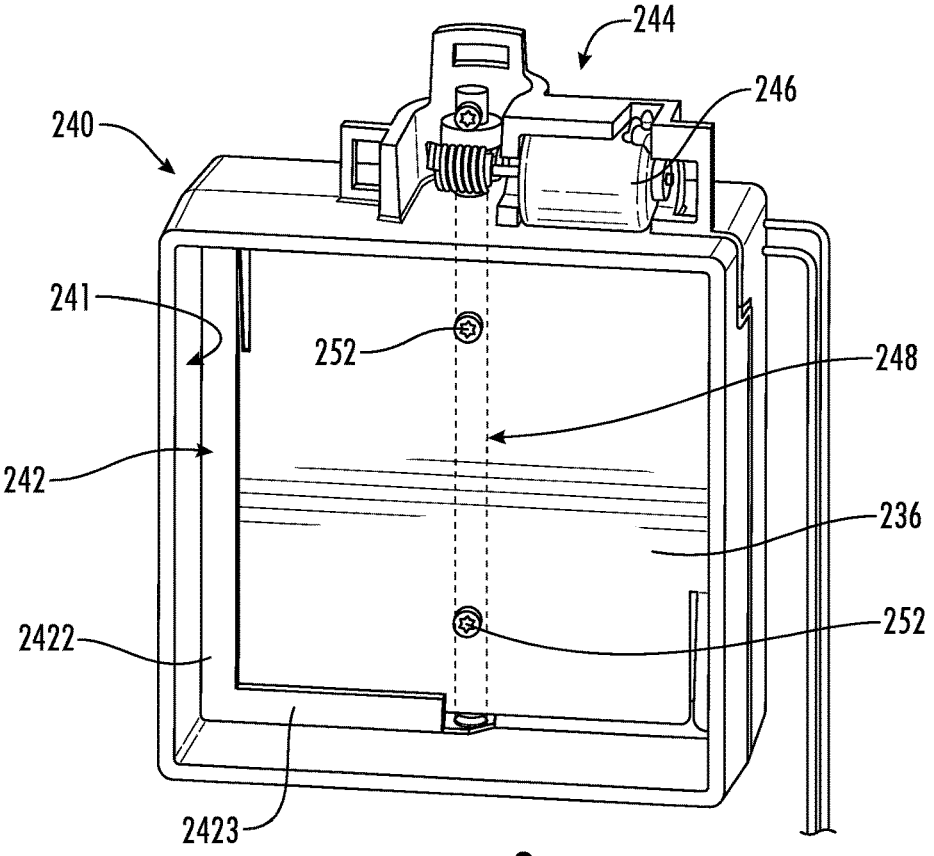
FIG. 8 provides a perspective view of a damper door within the make-up assembly of the exemplary air conditioner of FIG. 1.

Damper door 236 may be rotatably provided within secondary air duct 212 (e.g., to selectively open and close secondary passage 224). For instance, with reference to FIG. 8, a damper door frame 240 may be provided within secondary air duct 212. Damper door frame 240 may surround a periphery of secondary passage 224. In detail, damper door frame 240 may be attached to an inner surface of secondary air duct 212. In additional or alternative embodiments, damper door frame 240 is integrally formed with secondary air duct 212. For instance, damper door frame 240 may define a portion of secondary air duct 212. Accordingly, damper door frame 240 may simply refer to a portion of secondary air duct 212 in which damper door 236 is housed.

Damper door frame 240 may include a lip 242. Lip 242 may extend inward (e.g., into secondary passage 224) from an interior surface 241 of damper door frame 240. In detail, lip 242 may protrude along the lateral direction L and the vertical direction V from interior surface 241 (e.g., into secondary passage 224). Thus, lip 242 may be provided on each of an upper inner surface, a first lateral inner surface, and a lower inner surface of damper door frame 240. According to some embodiments, lip 242 forms a "=" shape (e.g., be generally C-shaped with respect to a cross-section of secondary passage 224). For instance, lip 242 may include a first portion 2421, a second portion 2422, and a third portion 2423.

First portion 2421 may protrude downward (e.g., along the vertical direction V) from the upper inner surface of damper door frame 240. First portion 2421 may extend a predetermined distance laterally (e.g., from the first lateral inner surface of damper door frame 240) towards a center of secondary passage 224. For one example, first portion 2421 extends between about 40% and about 45% of the total lateral width of secondary passage 224. Accordingly, a distal terminus of first portion 2421 may be provided between a center of secondary passage 224 (e.g., along the lateral direction L) and the first lateral inner surface of damper door frame 240.

Second portion 2422 may protrude inward (e.g., along the lateral direction L) from the first inner lateral surface of damper door frame 240. Second portion 2422 may extend throughout the entire height of secondary passage 224 along the vertical direction V. Thus, second portion 2422 may extend from the upper inner surface and the lower inner surface of damper door frame 240. Additionally or alternatively, second portion 2422 may connect first portion 2421 with second portion 2423 to form a continuous lip.

Third portion 2423 may protrude upward (e.g., along the vertical direction V) from the lower inner surface of damper door frame 240. Third portion 2423 may extend a predetermined distance laterally (e.g., from the first lateral inner surface of damper door frame 240) towards a center of secondary passage 224. For one example, third portion 2423 extends between about 40% and about 45% of the total lateral width of secondary passage 224. Accordingly, a distal terminus of third portion 2423 may be provided between a center of secondary passage 224 (e.g., along the lateral direction L) and the first lateral inner surface of damper door frame 240.

Lip 242 may protrude a predetermined distance into secondary passage 224. For instance, a protrusion distance of lip 242 may be a predetermined percentage of a total width (e.g., along the lateral direction L) or total height (e.g., along the vertical direction V) of secondary passage 224. The predetermined percentage may be between about 3% and about 8% of the total width (e.g., along the lateral direction L) or total height (e.g., along the vertical direction V) of secondary passage 224. Thus, lip 242 may selectively restrict damper door 236 from over-rotating within secondary passage 224. In other words, lip 242 may contact damper door 236 when damper door 236 is in a closed position (e.g., to restrict air flow through secondary passage 224).

Additionally or alternatively, a second lip 242 may be provided within secondary passage 224 (e.g., protruding inward from damper door frame 240). The second lip 242 may be a mirror of lip 242. For instance, the second lip 242 may form a "⊃" shape (e.g., be generally and inversely C-shaped) within secondary passage 224. Additionally or alternatively, the second lip may be offset from lip 242 along the transverse direction T (e.g., along an airflow direction within secondary passage 224). Thus, damper door 236 may be positioned between the first lip 242 and the second lip 242 along the transverse direction T. One or more features or dimensions of the second lip 242 may be identical (yet mirrored) to the above-described first lip 242. Accordingly, a detailed description thereof will be omitted for the sake of brevity.

Damper door 236 may be rotatably accommodated within damper door frame 240 (e.g., within secondary air duct 212). As mentioned above, damper door 236 may be selectively driven (e.g., rotated, opened) by a motor assembly 244. Motor assembly 244 may include a motor 246. In detail, motor 246 may be an electronic stepper motor capable of outputting rotational force. Motor 246 may be selectively driven through a predetermined range (e.g., arc range) to both open and close damper door 236 within secondary air duct 212. Thus, motor 246 may output a torque which can then be transferred to damper door 236 to provide rotation thereto. Motor 246 may be attached to secondary air duct 212. In at least some embodiments, motor 246 is positioned on an outer surface of secondary air duct 212 (e.g., via a motor mount). Additionally or alternatively, motor 246 may be positioned such that a rotational axis of motor 246 is defined along the lateral direction L. However, it should be understood that the rotational axis of motor 246 may be orientated in any suitable direction. Moreover, it should be understood that motor 246 may be any suitable motor capable of outputting rotational energy.

Motor assembly 244 may include a shaft 248. Shaft 248 may be selectively rotated by motor 246 (e.g., shaft 248 may selectively receive the output torque from motor 246). Shaft 248 may thus be operably connected with motor 246. Shaft 248 may define a damper door rotational axis 250. For instance, shaft 248 may rotate about damper door rotational axis 250. Shaft 248 may extend through secondary passage 224. In detail, shaft 248 may penetrate secondary air duct 212 (e.g., damper door frame 240) and extend at least partially into secondary passage 224. In some embodiments, shaft 248 is rotatably coupled to each of a top and bottom of secondary air duct 212 (e.g., at bearings provided thereto). Accordingly, shaft 248 may be rotatably stabilized within secondary air duct 212.

Damper door rotational axis 250 may be defined along the vertical direction V. Additionally or alternatively, damper door rotational axis 250 may be defined at or near the center of secondary passage 224 (e.g., along the lateral direction L). Accordingly, shaft 248 may be provided at or near the center of secondary passage 224 (e.g., along the lateral direction L). Shaft 248 may be attached to damper door 236. For instance, one or more fasteners 252 may selectively attach shaft 248 to damper door 236. Additionally or alternatively, shaft 248 may be integrally formed with damper door 236. Thus, as shaft 248 is rotated by motor 246, damper door 236 may be rotated within secondary passage 224.

Damper door 236 may be formed from a pliable or semi-pliable material. For instance, damper door 236 may be formed from a metal such as aluminum, galvanized steel, or the like. In a closed position, damper door 236 may extend along the lateral direction L and the vertical direction V. Accordingly, in the open position, damper door 236 may extend along the transverse direction T and the vertical direction V. However, the orientations given herein are merely examples, and damper door 236 may be situated in any suitable position. Additionally or alternatively, damper door 236 may be sized comparably to the cross-section of secondary passage 224. For instance, when damper door 236 is in the closed position, air (e.g., make-up air) may be restricted or prevented from flowing through secondary passage 224.

Damper door 236 may include a spring member 254. Spring member 254 may selectively bias damper door 236 against secondary air duct 212. For instance, spring member 254 may selectively bias damper door 236 against damper door frame 240. In at least some embodiments, spring member 254 selectively biases damper door 236 against lip 242 (e.g., when damper door 236 is moved to the closed position). Spring member 254 may thus be attached or fixed to damper door 236 (e.g., in biased engagement therewith).

According to some embodiments, spring member 254 is integrally formed with damper door 236 (e.g., as a single piece). For instance, with reference to FIGS. 9 and 10, one or more slits or cuts 255 may be made into damper door 236. Accordingly, damper door 236 may include a rigid body or main portion 256 and spring member 254, collectively. Main portion 256 may form a majority of damper door 256, while spring member 254 may extend from main portion 256 (e.g., as an integral lever or leaf spring).

Figure 9:
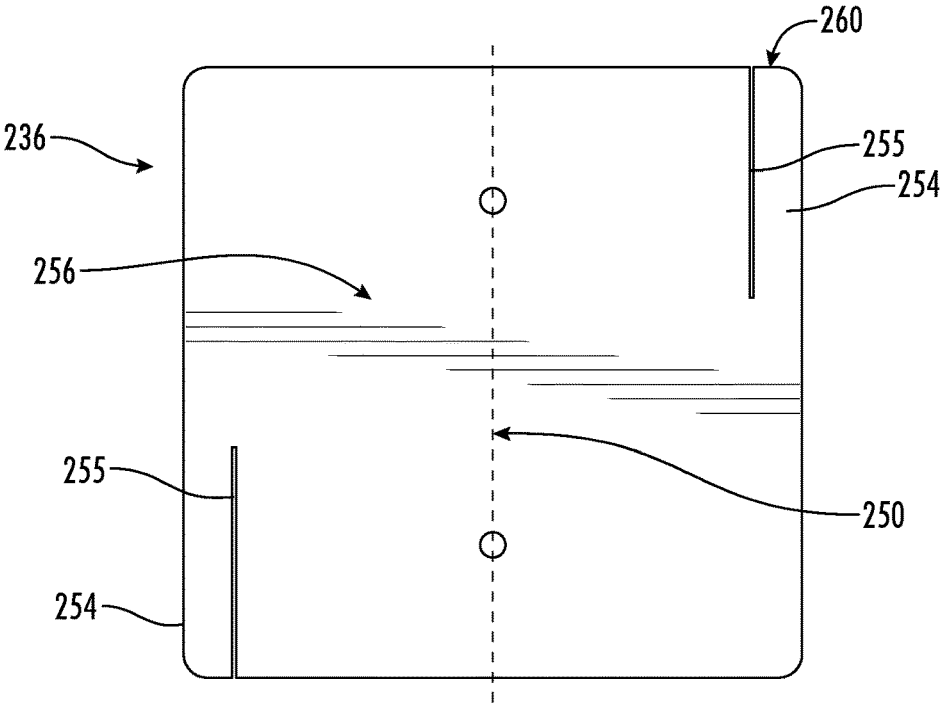
FIG. 9 provides a front view of the exemplary damper door of FIG. 8.

As shown, slit 255 may be formed along the vertical direction V. Slit 255 may extend downward a predetermined length into damper door 236. Thus, spring member 254 may be defined as a tab having a single end attached to main portion 256 of damper door 236. In detail, spring member 254 may include a first end 258 and a second end 260 opposite first end 258. First end 258 may be seamlessly formed with damper door 236 (e.g., as a unitary member with main portion 256). Accordingly, spring member 254 may extend from first end 258 toward second end 260. Spring member 254 may thus be a cantilevered member with respect to damper door 236 (e.g., main portion 256). Moreover, spring member 254 may be a cantilevered leaf spring. Spring member 254 may be provided at a lateral edge of damper door 236. However, it should be understood that a specific location of spring member 254 is not limited to the exampled given herein. For instance, spring member 254 may be provided at a lateral center of damper door 236, at a top center of damper door 236, at a bottom center of damper door 236, or the like. Additionally or alternatively, multiple spring members 254 may be formed, attached to, or utilized by damper door 236 (e.g., as shown in FIG. 9).

Figure 10:
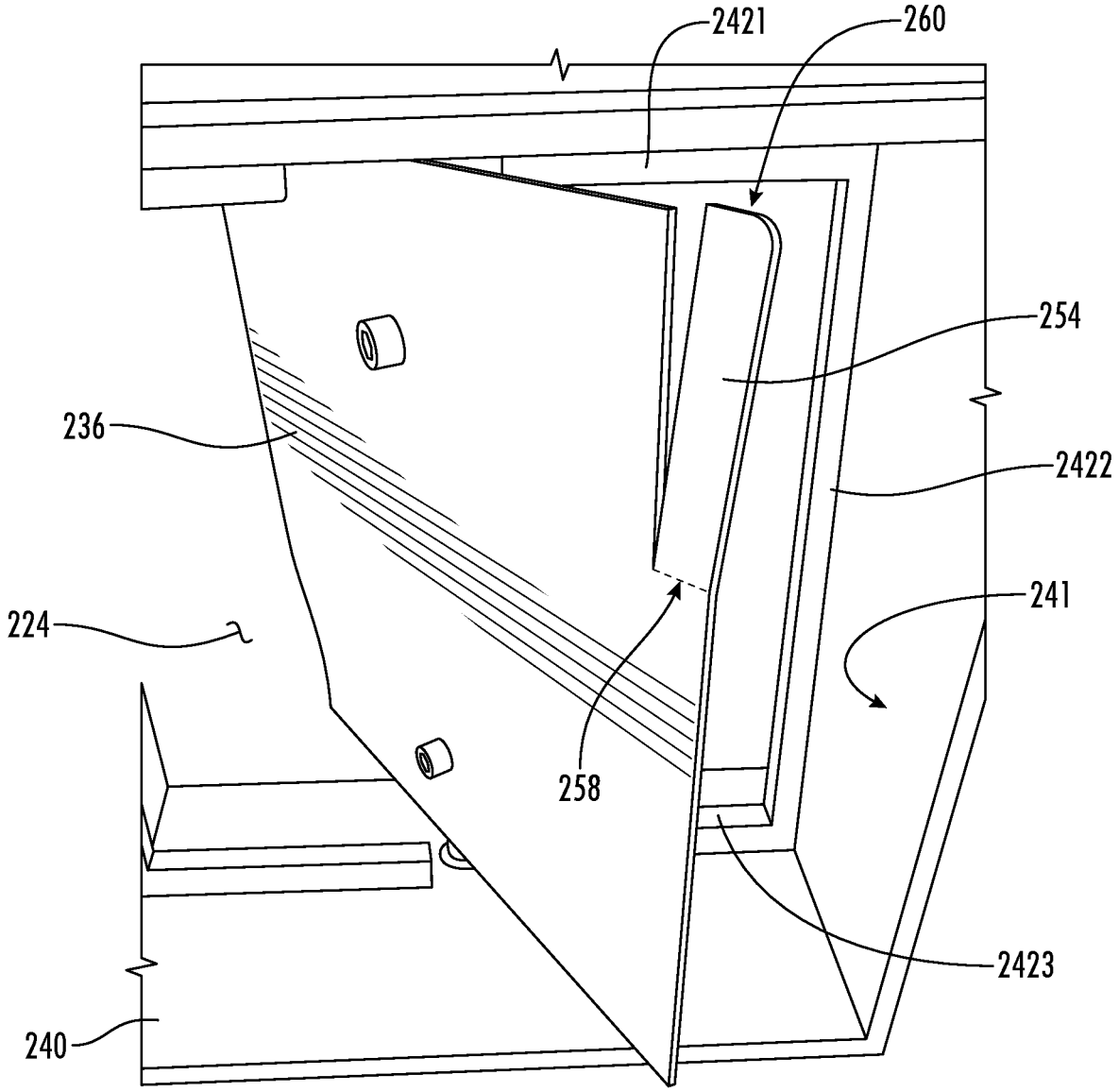
FIG. 10 provides a perspective view of the exemplary damper door of FIG. 8 with the damper door in an open position within a secondary air passage.

Spring member 254 may be bent with respect to main portion 256 of damper door 236. In detail, as best shown in FIG. 10, spring member 254 may extend at an acute angle with respect to main portion 256. The acute angle may be a non-zero angle (e.g., greater than 0°) and less than 90°. For instance, the angle at which spring member 254 extends from main portion 256 may be between about 2° and about 10°. However, the angle between the extension direction of spring member 254 and main portion 256 may vary according to specific embodiments, considering a spring constant of the material, a thickness of the material, a size of damper door 236, or the like.

Spring member 254 may extend generally toward the direction of rotation of damper door 236. For instance, second end 260 may be offset from a plane of damper door 236. Accordingly, when damper door 236 is moved toward the closed position, second end 260 of spring member 254 may contact damper door frame 240 (e.g., lip 242) and initiate a biasing force to resist further rotation of damper door 236. Advantageously, spring member 254 may gradually slow the rotation of damper door 236 and subsequently motor 246 when approaching the closed position, thereby reducing a noise of damper door 236 striking lip 242, reduce an impact force of damper door 236 against lip 242, disperse internal forces (e.g., of motor 246), and control a speed of damper door 236 throughout the closing operation.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A single-package air conditioner appliance defining a vertical direction, a lateral direction, and a transverse direction, the air single-package conditioner appliance comprising:

a housing defining an outdoor portion and an indoor portion, the housing further defining an indoor inlet upstream from the indoor portion and an outdoor outlet downstream from the outdoor portion;

an outdoor heat exchanger assembly disposed in the outdoor portion and comprising an outdoor heat exchanger and an outdoor fan;

an indoor heat exchanger assembly disposed in the indoor portion and comprising an indoor heat exchanger and an indoor fan;

a compressor in fluid communication with the outdoor heat exchanger and the indoor heat exchanger to circulate a refrigerant between the outdoor heat exchanger and the indoor heat exchanger;

an intake conduit extending from the housing, the intake conduit defining an intake passage upstream from the indoor inlet, the intake conduit further defining a secondary inlet upstream from the intake passage to permit air thereto;

a secondary air duct extending from the intake conduit outside of the housing upstream from the secondary inlet to direct air thereto, the secondary air duct defining a secondary air passage; and a damper door provided in the secondary air duct to selectively allow air therethrough, the damper door comprising a spring member selectively biasing the damper door against the secondary air duct.

2. The single-package air conditioner appliance of claim 1, wherein the spring member is a cantilevered leaf spring member provided at a lateral edge of the damper door.

3. The single-package air conditioner appliance of claim 1, wherein the spring member is integrally formed with the damper door as a single piece.

4. The single-package air conditioner appliance of claim 3, wherein the spring member comprises:

a first end seamlessly formed with the damper door; and a second end opposite the first end, the second end being offset from a plane of the damper door such that the spring member extends at an acute, non-zero angle with respect to the plane of the damper door.

5. The single-package air conditioner appliance of claim 1, wherein the secondary air duct comprises a damper door frame in which the damper door is rotatably accepted, wherein the spring member is selectively biased against the damper door frame.

6. The single-package air conditioner appliance of claim 5, wherein the damper door frame defines a lip extending laterally inward from the secondary air duct into the secondary air passage.

7. The single-package air conditioner appliance of claim 1, further comprising a motor assembly, the motor assembly comprising:

a motor attached to the secondary air duct;

a shaft selectively rotated by the motor, the shaft extending through the secondary air duct into the secondary air passage, wherein the shaft is coupled to the damper door to rotate the damper door within the secondary air passage.

8. The single-package air conditioner appliance of claim 1, wherein the damper door rotates about a rotational axis defined along the vertical direction, the rotational axis extending through a center of the secondary air passage.

9. The single-package air conditioner appliance of claim 1, wherein the secondary air duct is disposed on an outer surface of the housing.

10. A make-up air (MUA) assembly for a single-package air conditioner appliance comprising a housing defining an indoor inlet, the MUA assembly comprising:

an intake conduit attachable to the housing, the intake conduit defining an intake passage upstream from the indoor inlet, the intake conduit further defining a secondary inlet upstream from the intake passage to permit air thereto;

a secondary air duct extending from the intake conduit outside of the housing upstream from the secondary inlet to direct air thereto, the secondary air duct defining a secondary air passage; and a damper door provided in the secondary air duct to selectively allow air therethrough, the damper door comprising a spring member selectively biasing the damper door against the secondary air duct.

11. The MUA assembly of claim 10, wherein the spring member is a cantilevered leaf spring member provided at a lateral edge of the damper door.

12. The MUA assembly of claim 10, wherein the spring member is integrally formed with the damper door as a single piece.

13. The MUA assembly of claim 12, wherein the spring member comprises:

a first end seamlessly formed with the damper door; and a second end opposite the first end, the second end being offset from a plane of the damper door such that the spring member extends at an acute, non-zero angle with respect to the plane of the damper door.

14. The MUA assembly of claim 10, wherein the secondary air duct comprises a damper door frame in which the damper door is rotatably accepted, wherein the spring member is selectively biased against the damper door frame.

15. The MUA assembly of claim 14, wherein the damper door frame defines a lip extending laterally inward from the secondary air duct into the secondary air passage.

16. The MUA assembly of claim 10, further comprising a motor assembly, the motor assembly comprising:

a motor attached to the secondary air duct;

a shaft selectively rotated by the motor, the shaft extending through the secondary air duct into the secondary air passage, wherein the shaft is coupled to the damper door to rotate the damper door within the secondary air passage.

17. The MUA assembly of claim 10, wherein the MUA assembly defines a vertical direction, a lateral direction, and a transverse direction, and wherein the damper door rotates about a rotational axis defined along the vertical direction, the rotational axis extending through a center of the secondary air passage.

18. The MUA assembly of claim 10, wherein the secondary air duct is disposed on an outer surface of the housing.

* * * * *